US005688062A

United States Patent [19]

Shih

[11] Patent Number: 5,688,062

[45] Date of Patent: Nov. 18, 1997

[54] WRITING UTENSIL STRUCTURE

[76] Inventor: Chung-chen Shih, No. 815, Sec. 2, Changshui Rd., Tachu Li, Hsihu Chen, Changhua Hsien, Taiwan

[21] Appl. No.: 789,924

[22] Filed: Jan. 28, 1997

[51] Int. Cl.[6] ..... B43K 27/00; B43K 29/00

[52] U.S. Cl. ..... 401/18; 401/34; 401/52; 401/57; 401/88; 401/195; 401/98

[58] Field of Search ..... 401/131, 57, 52, 401/195, 88, 98, 262, 34, 18; 446/204

[56] References Cited

U.S. PATENT DOCUMENTS

| | | | |
|---|---|---|---|
| 362,404 | 5/1887 | Stockmann | 401/34 |
| 587,795 | 8/1897 | Crosby et al. | 446/204 X |
| 1,808,489 | 6/1931 | Bassi | 401/34 |
| 2,665,945 | 1/1954 | Barton | 401/262 X |
| 3,214,780 | 11/1965 | Sharpe | 401/131 X |
| 3,234,953 | 2/1966 | Moynihan | 401/195 X |

FOREIGN PATENT DOCUMENTS

| | | | |
|---|---|---|---|
| 633452 | 12/1949 | United Kingdom | 401/34 |

*Primary Examiner*—Steven A. Bratlie
*Attorney, Agent, or Firm*—Oppenheimer Poms Smith

[57] ABSTRACT

A writing utensil structure includes an upper body having an upper end portion with a first neck having two first lugs, and a lower end portion with a second neck having two second lugs. A cap has an inner wall defining a first recess for receiving the first neck, and a second recess for receiving the two first lugs. An intermediate body includes an upper end portion having an inner wall defining a first socket for receiving the second neck, and a second socket for receiving the two second lugs, and includes a lower end portion having an inner wall with a first space defined in a lower portion thereof, and a second space defined in a mediate portion thereof. A lower body includes an upper end portion having a third neck received in the first space. Two third lugs each protrude from the third neck and are each received in the second space. A first writing utensil is received in a first passage defined in the upper body, and a second writing utensil is received in a second passage defined in the lower body.

7 Claims, 4 Drawing Sheets

WRITING UTENSIL STRUCTURE

FIELD OF THE INVENTION

The present invention relates to a writing utensil structure, and more particularly to a utility writing utensil structure.

BACKGROUND OF THE INVENTION

A conventional writing utensil structure is shown in FIG. 5, and there will be a complete illustration in the detailed description of the preferred embodiments.

The present invention has arisen to mitigate and/or obviate the disadvantage of the conventional writing utensil structure.

SUMMARY OF THE INVENTION

In accordance with one aspect of the present invention, there is provided a writing utensil structure comprising an upper body including an upper end portion having a first neck with a reduced diameter, and a lower end portion having a second neck with a reduced diameter. Two first lugs each protrude from the first neck, and two second lugs each protrude from the second neck. A first passage is defined in the upper body and extends through the first neck.

A cap is mounted on the upper end portion of the upper body and includes an inner wall having a first recess defined in a lower portion thereof for receiving the first neck, and a second recess defined in a mediate portion thereof for receiving each of the two first lugs.

An intermediate body includes an upper end portion mounted on the lower end portion of the upper body and having an inner wall with a first socket defined in an upper portion thereof for receiving the second neck, and a second socket defined in a lower portion thereof for receiving each of the two second lugs, and includes a lower end portion having an inner wall with a first space defined in a lower portion thereof, and a second space defined in a mediate portion thereof.

A lower body includes an upper end portion having a third neck with a reduced diameter and received in the first space. Two third lugs each protrude from the third neck and are each received in the second space. A second passage is defined in the upper end portion of the lower body and extends through the third neck.

A first writing utensil is received in the first passage, and a second writing utensil is received in the second passage.

Further features of the present invention will become apparent from a careful reading of the detailed description with appropriate reference to the accompanying drawings.

DETAILED DESCRIPTION OF THE PREFERRED EMBODIMENTS

Figure 5:
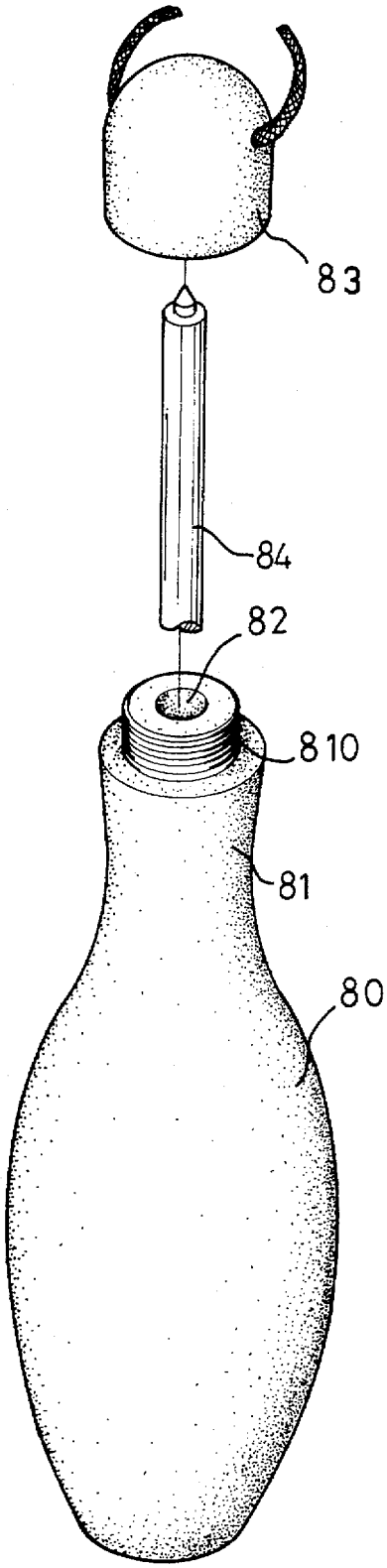
FIG. 5 PRIOR ART
FIG. 5 is an exploded view of a conventional writing utensil structure in accordance with the prior art.

For a better understanding of features and benefits of the present invention, reference is made to FIG. 5, illustrating a conventional writing utensil structure in accordance with the prior art. The conventional writing utensil structure comprises a housing 80 having an upper end portion 81 with a threaded neck 810 threadedly engaged in a cap 83, and a writing utensil 84 such as a pen, a pencil and the like received in a passage 82 defined in the housing 80.

By such an arrangement, however, the cap 83 is mounted on the housing 80 by means of a threaded engagement such that a user has to screw/unscrew the cap 83 on/from the housing 80 so as to tighten/loosen the cap 83 on/from the housing 80, thereby easily causing an inconvenience when being in use, especially in a condition when rapid removal of the pen 84 from the cap 83 is required.

In addition, the housing 80 simply functions to receive the pen 84 therein, thereby greatly limiting the versatility of the writing utensil structure.

Figure 1:
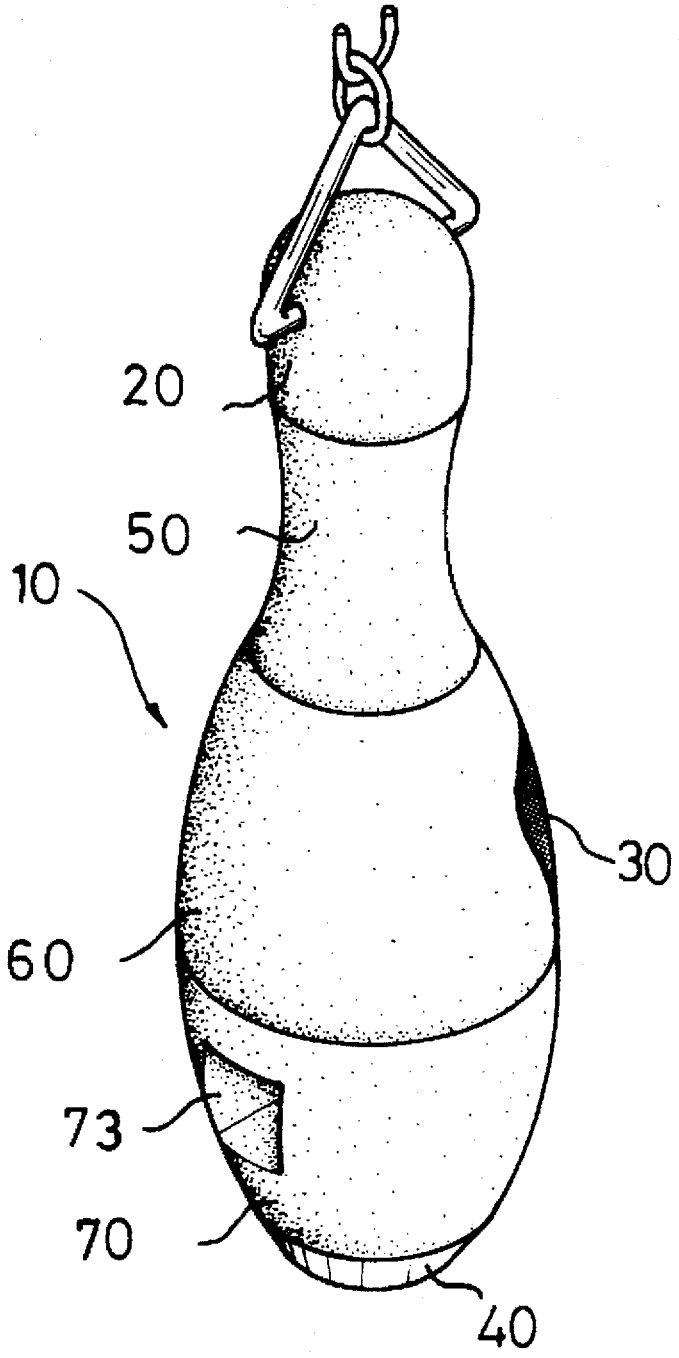
FIG. 1 is a perspective view of a writing utensil structure in accordance with the present invention.
Figure 2:
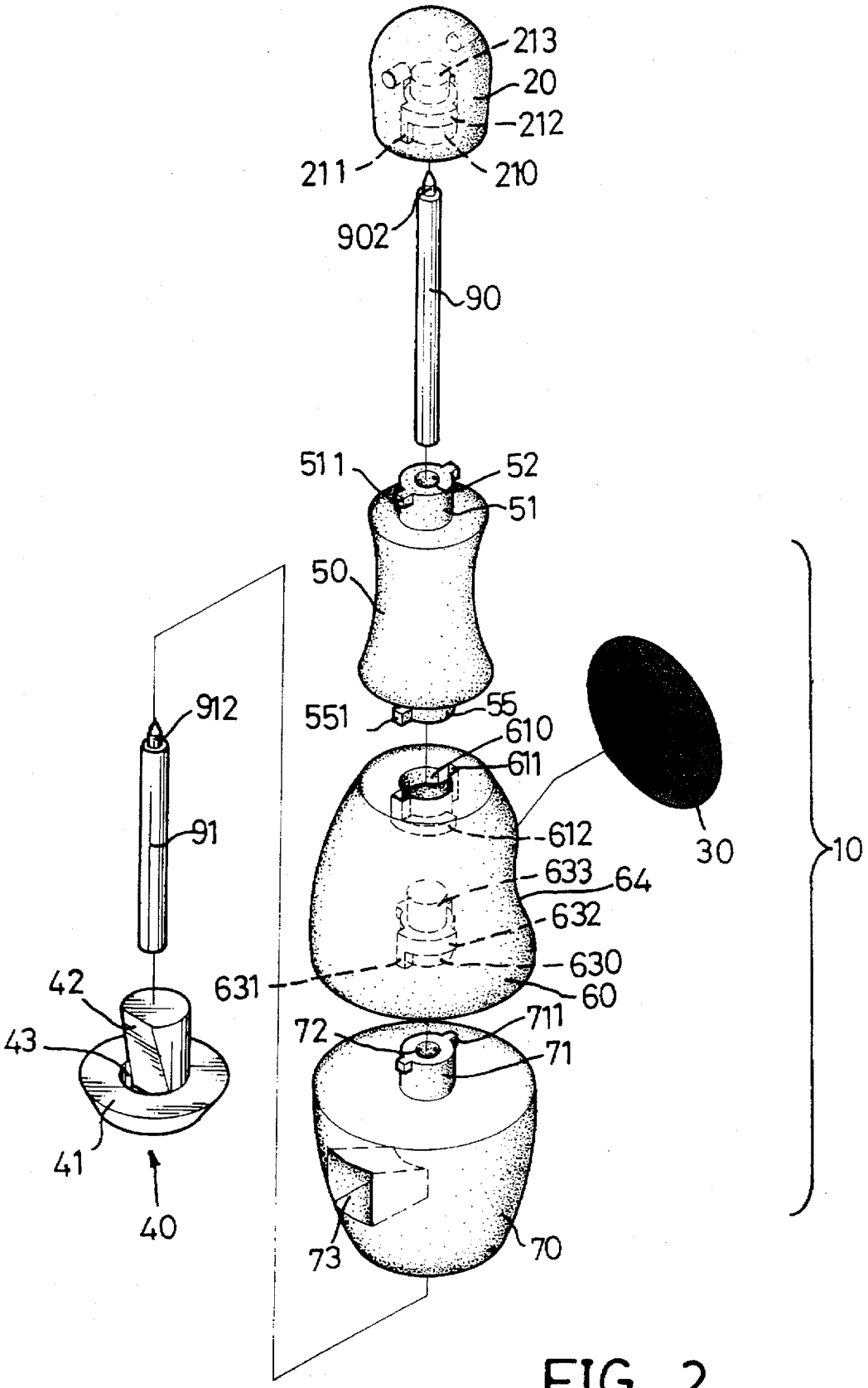
FIG. 2 is an exploded view of FIG. 1.
Figure 3:
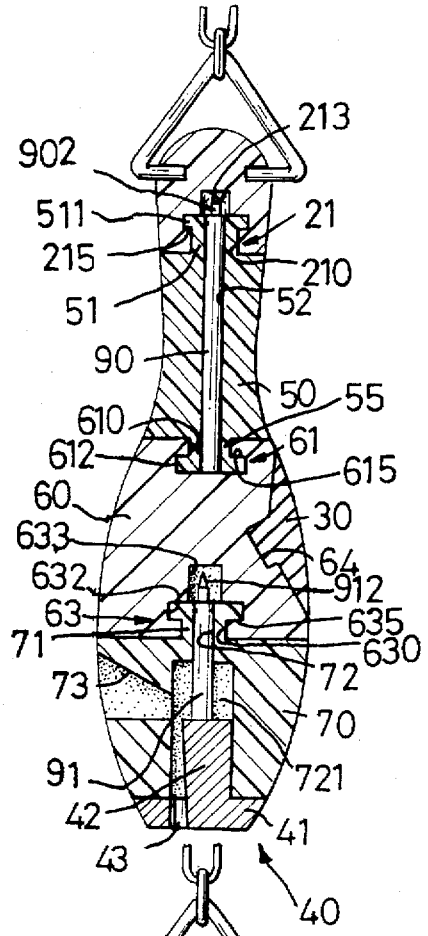
FIG. 3 is a front plan cross-sectional view of FIG. 1.

Referring now to FIGS. 1–3, a utility writing utensil structure in accordance with the present invention can provide multifunctions and comprises a housing 10 having a bowling pin configuration.

The housing 10 comprises an upper body 50 including an upper end portion having a first neck 51 with a reduced diameter and extending upwardly, and a lower end portion having a second neck 55 with a reduced diameter and extending downwardly. Two diametrically opposite first lugs 511 and two diametrically opposite second lugs 551 each protrude from the first neck 51 and the second neck 55 respectively. A first passage 52 is longitudinally defined in the upper body 50 and extends through the first neck 51.

A cap 20 is mounted on the upper end portion of the upper body 50 and includes an inner wall 21 having a first recess 210 defined in a lower portion thereof for receiving the first neck 51, a second recess 212 defined in a mediate portion thereof for receiving each of the two first lugs 511, and a third recess 213 defined in an upper portion thereof.

Two diametrically opposite cavities 211 are each defined in a periphery defining the first recess 210 and each communicate with the second recess 212 such that each of the two first lugs 511 can pass through a corresponding one of the two cavities 211 into the second recess 212.

The second recess 212 has a diameter greater than that of the first recess 210, and a shoulder 215 formed between the first recess 210 and the second recess 212 for limiting each of the two first lugs 511.

A first writing utensil 90 such as a pen, a pencil and the like is received in the first passage 52 and has an upper end with a tip 902 received in the third recess 213.

An intermediate body 60 includes an upper end portion mounted on the lower end portion of the upper body 50 and having an inner wall 61 with a first socket 610 defined in an upper portion thereof for receiving the second neck 55, and a second socket 612 defined in a lower portion thereof for receiving each of the two second lugs 551. The intermediate body 60 further includes a lower end portion having an inner wall 63 with a first space 630 defined in a lower portion thereof, a second space 632 defined in a mediate portion thereof, and a third space 633 defined in an upper portion thereof.

The intermediate body 60 also laterally defines a well 64 for receiving a resilient plug 30 such as an eraser.

Two diametrically opposite cavities 611 are each defined in a periphery defining the first socket 610 and each communicate with the second socket 612 such that each of the two second lugs 551 can pass through a corresponding one of the two cavities 611 into the second socket 612.

The second socket 612 has a diameter greater than that of the first socket 610, and a shoulder 615 formed between the first socket 610 and the second socket 612 for limiting travel each of the two second lugs 551.

A lower body 70 includes an upper end portion having a third neck 71 with a reduced diameter and received in the first space 630. Two diametrically opposite third lugs 711 each protrude from the third neck 71 and are each received in the second space 632.

A second passage 72 is defined in the upper end portion of the lower body 70 and extends through the third neck 71. An enlarged diameter chamber 721 is defined in a lower end portion of the lower body 70 and communicates with the second passage 72.

A second writing utensil 91 such as a pen, a pencil or the like is received in the second passage 72 and has an upper end with a tip 912 received in the third space 633.

Two diametrically opposite cavities 631 are each defined in a periphery defining the first space 630 and each communicate with the second space 632 such that each of the two third lugs 711 can pass through a corresponding one of the two cavities 631 into the second space 632.

The second space 632 has a diameter greater than that of the first space 630, and a shoulder 635 formed between the first space 630 and the second space 632 for limiting each of the two third lugs 711.

A sound diffusing opening 73 is laterally defined in the lower end portion of the lower body 70 and communicates with the chamber 721. A sound generating member 40 includes a cover 41 attached to the lower end portion of the lower body 70 by means of such as an adhesive, and a sound emitting nozzle 43 defined in the cover 41 and communicating with the chamber 721.

Preferably, the sound diffusing opening 73 is disposed in a plane that is perpendicular to that of the sound emitting nozzle 43. In addition, the sound generating member 40 further includes a sound guiding wedge 42 protruding from the cover 41 to be received in the chamber 721, and located between the sound diffusing opening 73 and the sound emitting nozzle 43.

A user can blow air into the chamber 721 via the sound emitting nozzle 43 and then into the sound diffusing opening 73 via the sound guiding wedge 42, thereby generating sound such that the writing utensil structure can function as a whistle.

In operation, the cap 20 can be rotated relative to the upper body 50 to a position where each of the two first lugs 511 aligns with the respective cavity 211 such that the cap 20 can be detached from the upper body 50 easily, thereby exposing the tip 902 of the first pen 90 for a user's use.

Alternatively, the lower body 70 can be rotated relative to the intermediate body 60 to a position where each of the two third lugs 711 aligns with the respective cavity 631 such that the lower body 70 can be detached from the intermediate body 60 easily, thereby exposing the tip 912 of the second pen 99 for the user's use.

Figure 4:
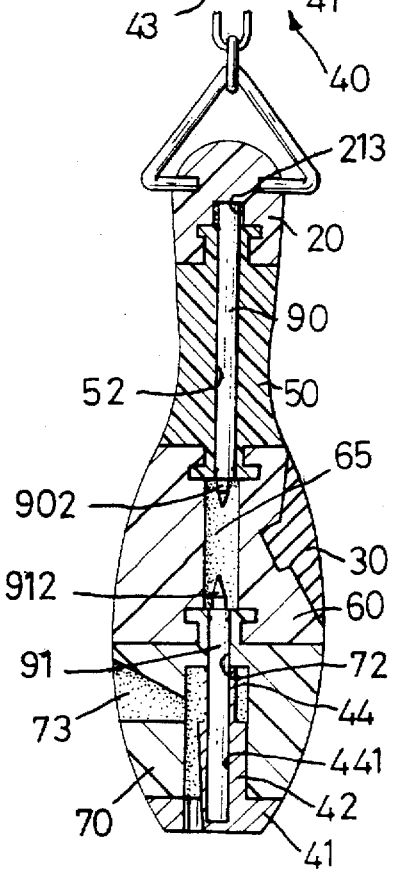
FIG. 4 is a front plan cross-sectional view according to a second embodiment of the present invention.

Referring now to FIG. 4, in accordance with a second embodiment of the present invention, the intermediate body 60 has a channel 65 defined therein for receiving the tip 902 of the first pen 90 and the tip 912 of the second pen 91. In addition, the sound guiding wedge 42 has an elongate extension 44 extending upwardly with a channel 441 defined therein for receiving the second pen 91.

It should be clear to those skilled in the art that further embodiments of the present invention may be made without departing from the spirit and scope of the present invention.

What is claimed is:

1. A writing utensil structure comprising:

a housing (10) comprising:

an upper body (50) including an upper end portion having a first neck (51) with a reduced diameter and extending upwardly, and a lower end portion having a second neck (55) with a reduced diameter and extending downwardly, two diametrically opposite first lugs (511) each protruding from said first neck (51), two diametrically opposite second lugs (551) each protruding from said second neck (55), a first passage (52) longitudinally defined in said upper body (50) and extending through said first neck (51);

an intermediate body (60) including an upper end portion mounted on the lower end portion of said upper body (50) and having an inner wall (61) with a first socket (610) defined in an upper portion thereof for receiving said second neck (55), and a second socket (612) defined in a lower portion thereof for receiving each of said two second lugs (551), and including a lower end portion having an inner wall (63) with a first space (630) defined in a lower portion thereof, a second space (632) defined in a mediate portion thereof, and a third space (633) defined in an upper portion thereof;

a lower body (70) including an upper end portion having a third neck (71) with a reduced diameter and received in said first space (630), two diametrically opposite third lugs (711) each protruding from said third neck (71) and each received in said second space (632), a second passage (72) longitudinally defined in the upper end portion of said lower body (70) and extending through said third neck (71);

a cap (20) mounted on the upper end portion of said upper body (50) and including an inner wall (21) having a first recess (210) defined in a lower portion thereof for receiving said first neck (51), a second recess (212) defined in a mediate portion thereof for receiving each of said two first lugs (511), and a third recess (213) defined in an upper portion thereof;

a first writing utensil (90) received in said first passage (52) and having an upper end with a tip (902) received in said third recess (213); and a second writing utensil (91) received in said second passage (72) and having an upper end with a tip (912) received in said third space (633).

2. The writing utensil structure in accordance with claim 1, wherein said second recess (212) has a diameter greater than that of said first recess (210), and a shoulder (215) formed between said first recess (210) and said second recess (212) for limiting each of said two first lugs (511).

3. The writing utensil structure in accordance with claim 1, wherein said second socket (612) has a diameter greater than that of said first socket (610), and a shoulder (615) formed between said first socket (610) and said second socket (612) for limiting each of said two second lugs (551).

4. The writing utensil structure in accordance with claim 1, wherein said second space (632) has a diameter greater than that of said first space (630), and a shoulder (635) formed between said first space (630) and said second space (632) for limiting each of said two third lugs (711).

5. The writing utensil structure in accordance with claim 1, wherein two diametrically opposite cavities (211) are each defined in a periphery defining said first recess (210) and each communicate with said second recess (212) such that each of said two first lugs (511) can pass through a corre sponding one of said two cavities (211) into said second recess (212).

6. The writing utensil structure in accordance with claim 1, wherein two diametrically opposite cavities (611) are each defined in a periphery defining said first socket (610) and each communicate with said second socket (612) such that each of said two second lugs (551) can pass through a corresponding one of said two cavities (611) into said second socket (612).

7. The writing utensil structure in accordance with claim 1, wherein two diametrically opposite cavities (631) are each defined in a periphery defining said first space (630) and each communicate with said second space (632) such that each of said two third lugs (711) can pass through a corresponding one of said two cavities (631) into said second space (632).

* * * * *